US006715219B2

(12) United States Patent
Bock

(10) Patent No.: US 6,715,219 B2
(45) Date of Patent: Apr. 6, 2004

(54) WEIGHTED FOOTWEAR INSERT

(76) Inventor: Samuel Bock, 777 Querbes Ave., Outremont, Quebec (CA), H2V 3W8

( * ) Notice: Subject to any disclaimer, the term of this patent is extended or adjusted under 35 U.S.C. 154(b) by 0 days.

(21) Appl. No.: 10/043,593

(22) Filed: Jan. 14, 2002

(65) Prior Publication Data

US 2003/0131504 A1 Jul. 17, 2003

(51) Int. Cl.[7] ..... A43B 5/00; A43B 13/14; A43B 13/38; A63B 23/04

(52) U.S. Cl. ..... 36/132; 36/44; 36/31; 482/79

(58) Field of Search ..... 36/132, 44, 107, 36/31, 43, 102, 103, 152, 177; 482/79

(56) References Cited

U.S. PATENT DOCUMENTS 3,922,801 A * 12/1975 Zente ..... 36/44
4,471,538 A * 9/1984 Pomeranz et al. ..... 36/43
4,709,921 A * 12/1987 Valuikas et al. ..... 36/44
4,779,361 A * 10/1988 Kinsaul ..... 36/102
4,888,888 A * 12/1989 Ashton ..... 36/44
5,231,776 A * 8/1993 Wagner ..... 36/114
5,384,973 A * 1/1995 Lyden ..... 36/102
6,151,803 A * 11/2000 Charles ..... 36/72 R
6,502,331 B2 * 1/2003 Hines ..... 36/43

* cited by examiner

*Primary Examiner*—Anthony D. Stashick

(57) ABSTRACT

A weighted footwear insert for use inside a footwear. The weighted footwear insert includes a weighted plate defining at least one longitudinal fold line and a plurality of transversal fold lines. The fold lines are specifically positioned so as to allow the weighted plate to follow the contour of the sole of a foot during movement of the latter.

27 Claims, 4 Drawing Sheets

WEIGHTED FOOTWEAR INSERT

FIELD OF THE INVENTION

The present invention relates to the general field of footwear accessories and is particularly concerned with a weighted footwear insert.

BACKGROUND OF THE INVENTION

The efficiency of weights for improving muscle strength and tone is well established. Athletes in particular, for example, have long been training with weights mounted on the lower limbs in order to develop muscles for running, jumping and the like. Non-athletes can also benefit from such training aids by merely incorporating the use of the training aids in their daily regimens of moving about. Repeated use of such lower limb mounted weights when active can lead to strengthening of the leg muscles, increase in cardiovascular capacity and a generally higher metabolic rate. It is also believed that rehabilitative efforts might be hastened and improved with specific training of locally mounted weights.

The prior art is replete with various types of structures for adding weight to the lower limbs of intended users. One particularly popular method of adding weight to the lower limbs makes use of conventional ankle weights, including a strap configured and sized for mounting around the ankles, and having weights attached thereto. Apart from being most uncomfortable, one of the drawbacks associated with conventional ankle weights is that the ankle takes too much shock with each step or stride when the weight is placed around the ankle, as the ankle itself is what stops the mass of the weight from accelerating to the ground with each step. This causes the weight to jam the ankle with each step, leading to stretched ligaments and sore tendons after several weeks of use.

The intended mass needs to be below the foot if the body is to be prevented from decelerating the mass with each step. If the mass is below the foot, the ground the foot is striking stops the mass instead, eliminating shock to the body.

The solution to eliminating shock from weight placed above the ankle is to attach or incorporate the weight to the footwear. This solution has been recognised in the prior art. Indeed, some prior art patents disclose footwear incorporating weighted elements. For example, U.S. Pat. No. 4,458,433 issued Jul. 10, 1984 and naming Frank Stempski as inventor discloses a footwear having a weight pocket at the outside of a toe region of the upper structure for receiving removable weights therein. The structure also proposes optional heel and side pockets for additional weights. The structure disclosed in U.S. Pat. No. 4,448,432 however has major flaws including that positioning of the weight above the sole of the foot tends to create awkward muscle development. The disclosed structure also makes it difficult to prevent the weighted mass from moving around under heavy accelerations.

U.S. Pat. No. 5,231,776 issued Aug. 3, 1993 naming Rodger D. Wagner as inventor discloses a footwear incorporating a grid matrix which is moulded into the footwear and sandwiched between the inner and outer sole of the latter. Relatively small weighted spheres typically of less than 1 mm of diameter are inserted into the lattice grid matrix. Although presenting a somewhat elegant solution to the problem of weight distribution, the structure disclosed in the U.S. Pat. No. 5,231,776 suffers from the fact that the weight is permanently fixed into the shoe. The structure thus lacks in versatility and transferability between shoes.

U.S. Pat. No. 3,517,928 discloses a weighted shoe using a weight receiving member frame inside the shoe, the weight receiving member frame being coextensive with the sole. The weight-receiving frame is permanently built into the shoe and has openings for receiving different weight plugs. One of the main disadvantages associated with this device is that a favourite or expensive shoe would need to be permanently altered to properly incorporate the member frame according to the disclosure.

U.S. Pat. No. 4,252,315 issued Feb. 24, 1981 naming Akira Kimura as inventor discloses a training aid including a toe portion and a heel portion with both having a core member made of heavy metal and a resilient covering member surrounding the core member. The toe and heel portions are so shaped that they form substantially a sole configuration when they are placed side by side on the sole of a shoe.

One of the main drawbacks associated with the structure disclosed in U.S. Pat. No. 4,252,315 relates to the lack of flexibility of the core members which leads to discomfort and potential injury to the wearer since the core members are unable to conform to the wearer's foot contour especially during motion.

The problem of weighted insoles having insufficient flexibility and being unable to conform to the changing configuration of a foot during motion has been recognized in the prior art. Attempts have been made to at least partially solve the problem. For example, U.S. Pat. No. 4,709,921 naming Antonette G. Valuikas and Ralph Valuikas as inventors and issued Dec. 1, 1987, as well as U.S. Pat. No. 5,638,613 naming James H. Williams and issued Jun. 17, 1997, both specifically address the lack of flexibility issue.

U.S. Pat. 4,709,921 discloses a weighted shoe insert having a weighted base member formed either as an integral portion of a shoe, or as a discrete insert sandwiched between an upper adhesively backed cover and a lower adhesively backed cover. The base member contains a series of perforation and edge contours which facilitate the shaping of the base member to conform with the shape of a human foot. In a second preferred embodiment, the base member is composed of a series of discrete elements in which chafing between adjacent segments has been substantially reduced by the contouring of the edges.

U.S. Pat. No. 5,638,613 discloses a weighted insole having a pair of flat weights encapsulated inside a flexible material, which is formed into an insole for placement in a shoe. A first weight is encapsulated in front and a second weight is encapsulated behind the ball of the foot area. The second weight additionally has cutouts at the arch and heel areas of the foot.

These unweighted areas throughout their thicknesses include insole materials that provide extra comfort and cushioning where the user typically places more weight on the foot. The front and back weighted construction additionally allows for flexibility of the insole at the ball area. A pattern of nodes is projected from the bottom of the insole to frictionally hold the insole in place in the shoe.

Although U.S. Pat. Nos. 4,252,315, 4,709,921 and 5,638,613 recognize the need for a flexible sole they still disclose structures presenting inherent major drawbacks that are not taking into account the relative complexity of the human foot and the knowledge emanating from the field of advanced athlete training and rehabilitation. In order to fully understand the problems associated with prior art structures and the advantages associated with the present invention a basic knowledge of foot anatomy is required.

The foot and ankle combine flexibility with stability because of the many bones they comprise and because of their shapes. The lower leg, ankle and foot have two principle functions, mainly propulsion and support. For propulsion, they act like a flexible lever. For support, they act like a rigid structure that holds up the entire body. The foot performs several important functions such as acting as a support base that provides the necessary stability for upright posture with minimal muscle effort, providing a mechanism for rotation of the tibia and fibula during the stance phase of gait, providing flexibility to adapt to uneven terrain, providing flexibility for absorption of shock by becoming a rigid structure in the pronated position and acting as a lever during "push-off".

The joints of the lower leg, ankle and foot act as functional groups not as isolated joints. The movement occurring at each individual joint is minimal. However, when combined, there normally is sufficient range of motion in all of the joints to allow functional mobility as well as functional stability. A suitable insole structure thus must take into account the movements occurring at each individual joint, however minimal. In particular, a suitable insole structure must take into account the movements occurring at each individual joint not only the movements leading to a flexing of the foot about a generally transversally oriented pivotal axis but also at the joints leading to flexing of the foot about a generally longitudinal pivotal axis orientation or a combination of both longitudinal and transversal orientation.

For ease of understanding, the joints of the foot are divided into three sections namely hind-foot or tarsus, the mid-foot or mid-tarsus, and the forefoot or metatarsus. The hind-foot contains two bones, the talus and the calcaneus. The joints of the hind-foot are the tibiofibular joints. The interior or distal tibiofibular joint is a fibrous or syndesmosis type of joint. The movements at this joint are minimal but allow a small amount of spread at the ankle joint during dorsiflexion.

The talocrural joint, or ankle joint, is a uniaxial, modified hinge synovial joint located between the talus, the medial malleolus of the tibia and the lateral malleolus of the fibula. The talocrural joint is designed for stability, not mobility. The subtalar joint is a synovial joint having three degrees of freedom and a closed pack position of supination. The movements possible at the subtalar joints are gliding and rotation. In addition, medial rotation of the leg causes a valgus, or outward movement of the calcaneus. Lateral rotation of the leg produces a varus or inward movement of the calcaneus.

The mid-tarsal joints part of the mid-foot include the talocalcaneonavicular joint, typically a ball and socket and synovial joint with three degrees of freedom. Movements possible at this joint are gliding and rotation. The cuneonavicular joint is a plain synovial joint. The movements possible at this joint are sliding and rotation. The cuboideonavicular joint is fibrous. The movements possible at this joint are gliding and rotation.

The intercuneiform joints are plain synovial joints. The movements possible at these joints are slight gliding and rotation. The cuneocuboid joint is a plain synovial joint. The movements of slight gliding and rotation are possible at this joint. The calcaneocuboid joint is a saddle shape with a closed pack position of supination. The movement possible at this joint is gliding with conjunct rotation. The mid-foot contains the three cuneiforms, the navicular and the cuboid and is separated from the hind-foot by the transverse mid-tarsal joint of Chopart.

The forefoot contains the five metatarsals and fourteen phalanges. It is separated from the midfoot by the tarsometatarsal joint of Lisfranc. Joints of the forefoot include the torsometatarsal joints which are plain synovial joints offering possible gliding movement. They also include four intermetatarsal joints which are plain synovial joints offering the possibility of gliding motion. They further include five metatarsophalangeal joints that are condyloid synovial joints with two degrees of freedom. The movements possible at these joints are flexion, extension, abduction and adduction. The joints of the forefoot further include interphalangeal joints, which are synovial hinged joints with one degree of freedom. The movements possible at these joints are flexion and extension.

The structures disclosed in the prior art patents fail to properly account for the possible movements of the numerous joints of the human foot necessary to allow for the proper biomechanical functioning fit. For example, both U.S. Pat. Nos. 4,252,315 and 5,638,613 assume that the mid and hind-foot are mostly static and that a relatively solid piece of material supporting both the mid and hind-foot will provide adequate support during motion. U.S. Pat. No. 5,638,613 discloses the use of a material allowing for semi-permanent forming in order to take into consideration the particular initial configuration of a static foot. However, it doesn't take into account that the sole of the foot is constantly changing in configuration during motion. The proposed semi-permanent design does not adapt to the foot's necessary freedom of movement and continual configuration change necessary for dynamic action found in athletic activity.

The typical foot active movements include plantar flexion of the ankle. During plantar flexion the heel of the foot will normally invert when the movement is performed when in weight bearing position. If heel inversion does not occur, the foot will be unstable. Dorsiflexion of the ankle or standing on the heels is usually 20 degrees past the anatomic position or when the foot is approximately at 90 degrees to bones of the leg. Supination or standing on the lateral edge of the foot and pronation or standing on the medial edge of the foot are respectively through ranges of 45 to 60 degrees and 15 to 30 degrees although there is variability among individuals. Supination or inward torsion combines the movements inversion, adduction and plantar flexion. Pronation or outward torsion combines the movements of eversion, abduction and dorsiflexion of the foot and ankle. The prior art patents fail to disclose structures allowing for the complete range of possible movements. For example, the lack of lateral flexibility renders both pronation and supination virtually impossible.

In normal stance, the body weight is equally distributed between the heel and ball of the foot. Muscular contraction is necessary to maintain this normal balance. For example, with muscle relaxation, 80 percent of the weight loaded on the knee will be distributed onto the metatarsal and 20 percent on the calcaneus. In normal stance, the contraction of the triceps surae creates an equal weight distribution between the metatarsal and the calcaneus.

Weight distribution among the metatarsal also depends on muscle contraction. In normal stance, the one half body weight borne by the metatarsals is distributed in the ratio 2:1:1:1:1 from the medial to the lateral rays. That is, the first metatarsal bears twice the weight of any of the others and one third of the weight carried by the forefoot or one sixth of the body weight. Studies have shown that relatively small changes in muscle balance and tone can result in significant changes in the load distribution of the foot. Therefore, the load mechanism in the foot is far more than an aesthetic arch. It depends on normal function of the bones, ligaments and muscles acting in concert.

Another factor affecting weight distribution is the direction of thrust of the tibia in standing and especially in walking and running. Torque on the tibia has significant effect on loading. Internal torsion produces pronation and loads the first ray, while external tibial torsion produces supination and loads the lateral rays. These loads, however, can be negated if muscles are contracted during loading. In walking, the weight is shifted from the heel to the ball of the foot in a straight line that parallels the line of forward progression. In a normal out-toeing gait, the weight moves from the lateral calcaneus and heel in a straight line forward to the head of the first metatarsal. In an ingoing gait, the heel strikes on the inner border of the heel and the weight moves towards the lateral metatarsal.

The structures disclosed in the prior art patents do not take into consideration the complexity of the movements of the various joints and, hence, the changes in the weight distribution during motion. The use of a material providing semi-permanent forming as proposed by the U.S. Pat. No. 5,638,613 and the use of an insole having only transversal perforations or transversally separated discrete elements as proposed by U.S. Pat. No. 4,709,921 simply do not account for variations in position and weight distribution occurring in the transversal direction during movement of the foot.

Furthermore, the prior art structure, by failing to take into consideration the transversally occurring phenomena, also failed to take into consideration the crucial role of the longitudinal arches of the foot for weight bearing. The arches of the foot are maintained by three mechanisms: wedging of the interlocking tarsal and metatarsal bones takes place; the ligaments on the plantar aspect of the foot play a significant role; and the intrinsic and extrinsic muscles of the foot and their tendons help to support the arches.

The longitudinal arches form a cone as a result of the angle formed by the metatarsal bones with the floor. The medial longitudinal arch being more evident, this angle is greater on the medial side. The specific cone shaped configuration of the longitudinal arches simply cannot be matched by the structures proposed in the prior art patents and, hence, the proper arch support results from these structures.

The medial longitudinal arch consists of the calcaneal tuborisity, the taleas and the nevicular bone, three cuneiforms and first, second and third metatarsal bones. The calcaneus, cuboid forth and fifth metatarsal bones make up the lateral longitudinal arch. The transverse arch consists of the navicular bone, cuneiforms and cuboid and metatarsal bones. The arch is sometimes divided into three parts, tarsal, posterior metatarsal and interior metatarsal. The loss of the interior metatarsal arch results in callous formation under the heads of the metatarsal bones. The metatarsal joints are slightly extended when the intended user is in the normal standing position because the longitudinal arches of the foot curve downward towards the toes. Normal arches of the foot hence play a crucial role for functional stability and mobility. Improper support of the arches may potentially lead to injury.

The fact that the prior art structures are not adapted to follow the changing contour of the sole of the feet in motion and to provide adequate arch support not only potentially leads to improper muscle development and potential injury, but it also actually leads to erroneous central nervous system adaptation which, in turn, may be detrimental to the performance of the athlete. Indeed, it has been shown that repeated training of specific biomechanical motions allows the establishment of motor memory between the brain and individual muscle cells through the central nervous system.

Unrelated motor activity associated with training muscles in matters that do not use the same biomechanical motion as used in competition can confuse the ability of the brain to establish the motor memory pathways necessary for the execution of specific athletic activities. One of the objectives of modern training is thus to train the brain and body to strengthen and learn a specific action in the least amount of time, with a minimum of other athletic activity which uses the brain and central nervous system in a different matter and which would potentially cause the brain to develop unrelated motor memory pathways.

In addition the biomechanical action of the muscle groups, the development of chemical energy generated by the cells of the muscle groups being used must also be considered. The rate of generation of chemical energy will differ with different levels of expenditure. Full speed activity uses exponentially more power than half or quarter speed activity. Individual muscle cells adapt only to the power level being repeatedly trained.

Prior art structures are not well adapted to establishing proper motor memory pathways, since the lack of flexibility on the proposed weighted plate forces the subject to use different biomechanical parameters during training as compared to those used during actual competition, or other specific activities without the plates. The use of training equipment which forces the subject to alter normal motor memory and biomechanical sequences also impedes the ability of individual muscle cells to fully develop energy output for competition, or other specifically intended uses.

The full development of an individual cell's maximum energy output is only possible if the cell is consistently being used or trained in the correct motor memory sequence. Training individual muscle cells in a different manner has been shown to primarily develop the cells for that particular motor sequence only. Transfer of such neuromuscular conditioning to other motor actions has been shown to be less than optimal. This is why modern sport training techniques have become very motor specific to the training task at hand.

Another drawback associated with prior art structures is that since the prior art insoles are made out of relatively large segments attached to each other, the pressure exerted by the foot of the intended user is not transmitted proportionally to corresponding areas of the shoe structure but rather partially absorbed and redistributed to the insole itself, which has no shock absorbing capability as compared to the midsole of modern training footwear, significantly altering and reducing the shock absorption properties of said footwear. This, in turn, reduces the overall bio-mechanical efficiency of the shoe-insole combination.

Other drawbacks associated with prior art structures are related to these specific types of materials and overall configurations that have been selected. Indeed, the structures disclosed in U.S. Pat. Nos. 4,709,921 and 5,638,613 are made of lead, a toxic material, which can potentially be absorbed by the human skin especially in the often hot and humid environment of a shoe during training.

Furthermore, the structures disclosed in U.S. Pat. Nos. 4,709,921 and 5,638,613 are relatively thick as compared with the structure of the proposed invention. When these relatively thick insoles are put in shoes that come with conventional modern insole liners, which are quite thin, they take up a relatively large volume, forcing the user to buy an extra pair of shoes to train. Indeed, most impact absorption in modern training shoes is provided by the advanced materials now found in the mid-soles of such footwear and not the insole itself. The modern insole that cover the stitching in the shoes upper construction is often very thin and differs in thickness and overall function from one shoe design to another. The relatively thick insoles proposed by U.S. Pat. Nos. 4,709,921 and 5,638,613 are proportionally relatively thick relative to the insoles of modern footwear.

Accordingly, there exists a need for an improved weighted footwear insert. Advantages of the present invention include that the proposed weighted footwear insert is specifically designed so as to follow the changing configuration of the sole of the feet of an intended user during motion.

The proposed weighted footwear insert is designed so as to take into account variations in configuration and weight distribution of a given foot sole section in a transversal direction. The improved flexibility of the proposed weighted footwear insert allows the latter to instantly and fully adapt to the mid-sole below and the insole above of the conventional shoe, thereby allowing full transfer of the footwear's cushioning properties.

The proposed weighted footwear insert allows for adequate support of the foot arches while providing flexibility thus reducing risk of injury during training.

Furthermore, the proposed weighted footwear insert allows for the development of optimized motor memory pathways during training. The proposed weighted footwear insert is configured so as to be easily transferable between pieces of footwear thus reducing the need for buying multiple inserts.

Furthermore, the proposed weighted footwear insert is designed as to be comfortable and easily concealed within conventional footwear so as not to deter to the overall aesthetical aspect of the latter. Furthermore, the proposed weighted footwear insert has a generally thin configuration so as to obliviate the need for buying a shoe of a larger size in order to incorporate the weighted footwear insert in accordance with the invention.

Still further, the proposed weighted footwear insert is specifically designed so as to transmit the pressure exerted by the foot of the intended user directly to the shoe structure with reduced alteration of the pressure distribution on the shoe structure so as to maintain the overall biomechanical efficiency of the shoe-insole combination.

The present invention also relates to a method for forming a weighted footwear insert in accordance with the present invention. The proposed method allows for reformation of a weighted footwear insert through a set of optimized steps that can be performed with conventional equipment and using conventional materials so as to allow for the production of a weighted footwear insert that will be economical, long lasting and relatively trouble free in operation. The proposed method also allows for the production of customized weighted footwear inserts that are optimized for specific individual biomechanical parameters and training techniques.

In accordance with an embodiment of the present invention, there is provided a weighted footwear insert for use inside a footwear, the footwear being wearable by a foot of an intended user, the foot having a foot sole, the footwear including a generally elongated insole, the insole defining an insole peripheral edge, an insole longitudinal axis and an insole transversal axis, the footwear insert comprising: a weighted plate, the weighted plate defining a plate first surface, a plate second surface, a plate toe end, a plate heel end, a plate peripheral edge, a plate longitudinal axis and a plate transversal axis, the weighted plate being configured and sized for insertion into the footwear with the plate longitudinal axis extending in a direction generally parallel to the insole longitudinal axis and the plate transversal axis extending in a direction generally parallel to the insole transversal axis; the weighted plate defining a first pair of plate segments, the plate segments defining a segment longitudinal fold line therebetween for allowing the plate segments to fold relative to one another about the segment longitudinal fold line; the segment longitudinal fold line defining a longitudinal fold line orientation axis, the longitudinal fold line orientation axis defining a longitudinal fold line-to-longitudinal axis angle between the longitudinal fold line orientation axis and the plate longitudinal axis, the longitudinal fold line orientation axis defining a longitudinal fold line-to-transversal axis angle between the longitudinal fold line orientation axis and the plate transversal axis; the longitudinal fold line-to-longitudinal axis angle being smaller in value then the longitudinal fold line-to-transversal axis angle; the weighted plate also including a generally transversally extending transversal bending means for allowing the weighted plate to bend along the transversal bending; whereby the longitudinal segment fold line extends in a more longitudinal then transversal direction for allowing the weighted plate to substantially follow the transversal contour of the foot sole.

Preferably, the transversal bending means includes a segment transversal fold line extending between the first pair of plate segments and a second pair of plate segments, both the first and the second pair of plate segments having their respective plate segments separated by the segment longitudinal fold line. Preferably, the transversal bending means includes a plurality of segment transversal fold lines.

Conveniently, the plate segments are disposed relative to each other so as to define a segment spacing therebetween; the weighted footwear insert further comprising a flexible coupling means attached to adjacent plate segments for flexibly coupling adjacent plate segments together so as to allow bending therebetween about the coupling means.

In one embodiment, the flexible coupling means includes a first flexible membrane fixed to the plate first surface on adjacent plate segments, the first flexible membrane extending across the segment spacing. Preferably, the flexible coupling means also includes a second flexible membrane fixed to the plate second surface on adjacent plate segments, the second flexible membrane also extending across the segment spacing. In another embodiment, the flexible coupling means includes a flexible web of material extending integrally between adjacent plate segments.

Optionally, the coupling means allows bending between the plate segments within a predetermined limited bending range. Optionally, the first pair of plate segment is made of plate segments having different densities. Optionally, the first pair of plate segments is made of plate segments having different cross-sectional configurations. Optionally, the segment longitudinal fold line extends across the weighted plate from the plate toe end to the plate heel end.

In accordance with one embodiment of the invention, the weighted footwear insert defines a main segment longitudinal fold line and a pair of auxiliary longitudinal fold lines, the main segment longitudinal fold line extending substantially longitudinally across the weighted plate and being substantially centrally positioned relative to the plate peripheral edges, the auxiliary longitudinal fold lines being positioned on each side of the main longitudinal fold line and following a direction so as to be in a generally central position between the main longitudinal fold line and an adjacent plate peripheral edge.

In accordance with another embodiment of the invention the weighted insert includes a main segment longitudinal fold line and a set of auxiliary longitudinal fold lines, the main segment longitudinal fold line extending substantially longitudinally across the weighted plate and being substantially centrally positioned relative to the plate peripheral edges, the auxiliary longitudinal fold lines being positioned on each side of the main longitudinal fold line between the main longitudinal fold line and an adjacent plate peripheral edge, the auxiliary fold lines extending from the plate toe end to a position intermediate to the plate toe and heel ends, the weighted footwear insert also including a plurality of segment transversal fold lines and a generally "U"-shaped fold line positioned adjacent the plate heel end.

Optionally, the weighted insert includes a plate aperture extending through the plate, the plate aperture being filled by a generally resilient material.

In accordance with the present invention there is also provided a weighted footwear insert for use inside a footwear, the footwear being wearable by a foot of an intended user, the foot having a foot sole, the weighted footwear insert comprising: a weighted plate, the weighted plate defining at least one generally longitudinally oriented longitudinal fold line and a set of generally transversally oriented transversal fold lines for allowing the weighted plate to fold according to the configuration of the foot sole and to follow the changes in configuration of the foot sole during movement of the foot.

The present invention also relates to a method of forming a weighted footwear insert comprising the steps of cutting a blank having substantially the planform of an insole into a relatively thin piece of generally dense material; forming at least one generally longitudinally oriented longitudinal fold line and a set of generally transversally oriented transversal fold lines in the blank.

Preferably, the method further comprises the step of determining an optimized blank configuration and fold line pattern for the foot taking into consideration the physiological characteristics of the foot prior to cutting the blank and the longitudinal and transversal fold lines according to the optimized blank configuration and fold line pattern.

BRIEF DESCRIPTION OF THE DRAWINGS

An embodiment of the present invention will now be disclosed, by way of example, in reference to the following drawings in which.

DETAILED DESCRIPTION OF THE INVENTION

Figure 1:
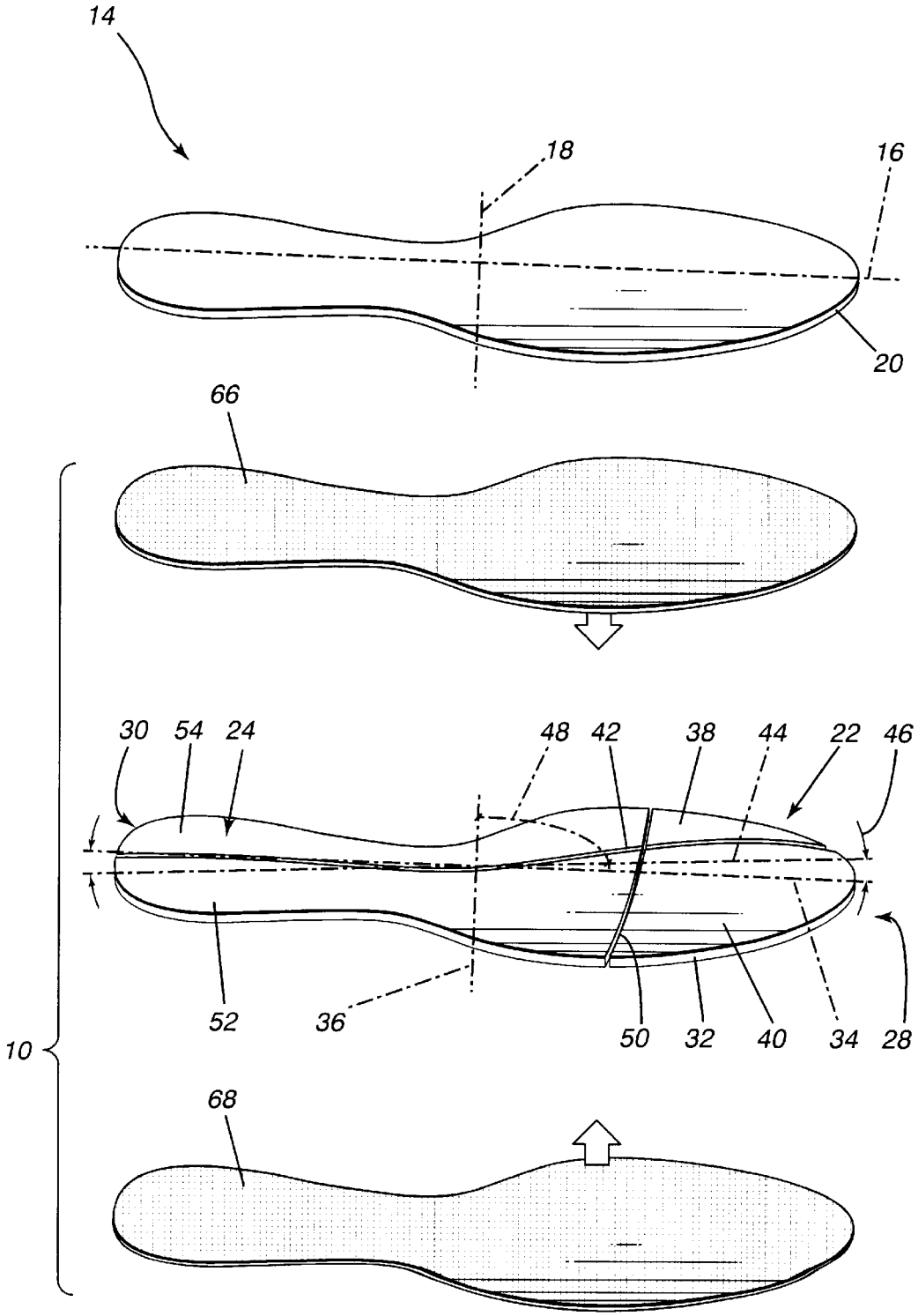
FIG. 1: in an exploded view illustrates a weighted footwear insert in accordance with an embodiment of the present invention, the weighted footwear insert being shown positioned underneath a conventional footwear insole.
Figure 2:
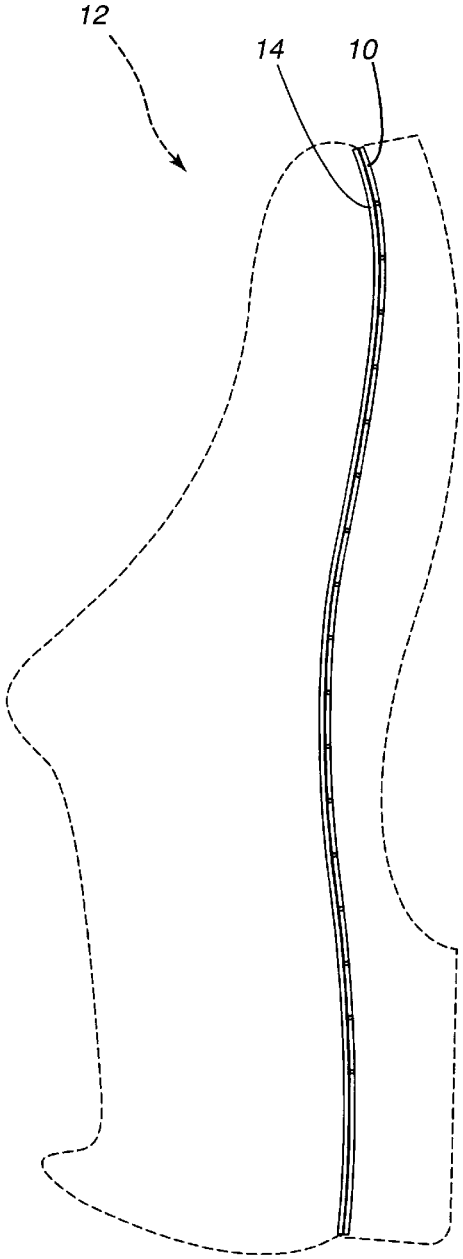
FIG. 2: in a side view illustrates a weighted footwear insert in accordance with an embodiment of the present invention mounted within a piece of conventional footwear, the conventional footwear being shown in phantom lines.
Figure 3:
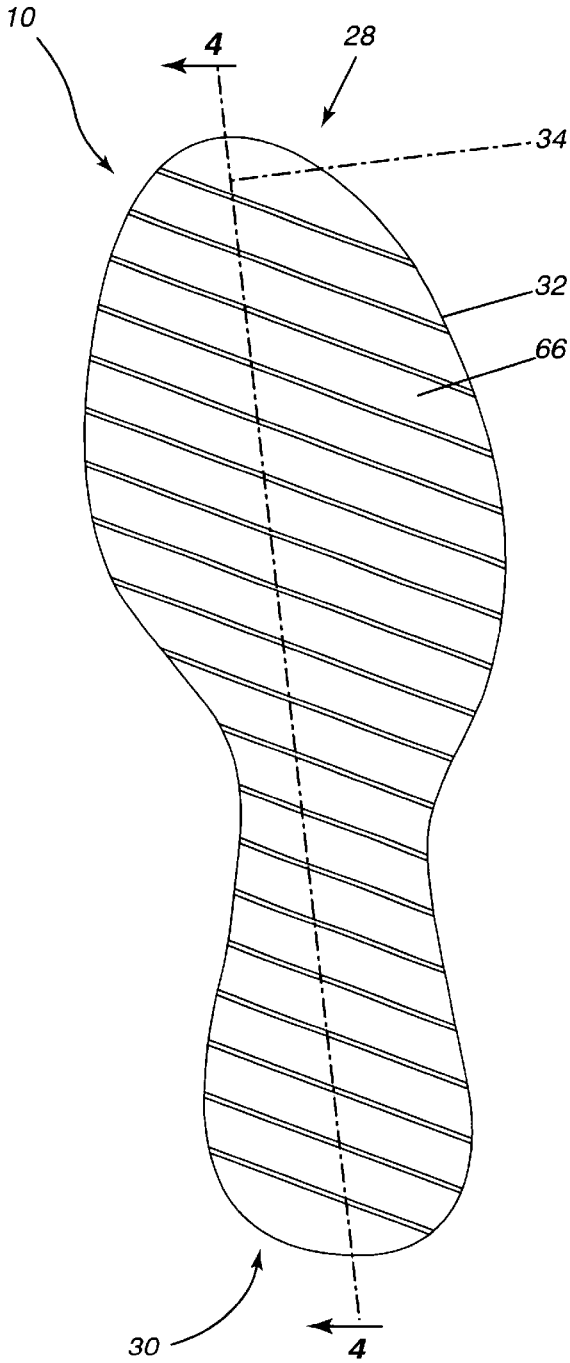
FIG. 3: in a top view illustrates a weighted footwear insert in accordance with an embodiment of the present invention.

Referring to FIG. 1, there is shown a weighted footwear insert 10 in accordance with an embodiment of the present invention. The weighted footwear insert 10 is adapted for use inside a conventional footwear such as the footwear 12 shown in phantom lines in FIG. 2. Typically, the weighted footwear insert 10 is designed so as to be positionable inside the footwear 12 underneath the footwear insole 14.

A conventional footwear insole 14 is shown in greater details in FIG. 1. The conventional footwear insole 14 typically has an elongated configuration defining an insole longitudinal axis 16, a generally perpendicular insole transversal axis 18 and an insole peripheral edge 20. The footwear is designed so as to be wearable by the foot of an intended user (not shown).

The weighted footwear insert 10 includes a weighted plate 22 defining a plate first surface 24, a plate second surface 26, a plate toe end 28, a plate heel end 30 and a plate peripheral edge 32. The weighted plate 22 also defines a plate longitudinal axis 34 and a generally perpendicular plate transversal axis 36.

The weighted plate 22 is configured and sized for insertion into the footwear 12 with the plate longitudinal axis 34 extending in a direction generally parallel to the insole longitudinal axis 16 and the plate transversal axis 36 extending in a direction generally parallel to the insole transversal axis 18.

The weighted plate 22 defines a first pair of plate segments 38, 40. The plate segments 38, 40 define a segment longitudinal fold line 42 therebetween for allowing the plate segments 38, 40 to fold relative to one another about said segment longitudinal fold line 42.

The segment longitudinal fold line 42 defines a longitudinal fold line orientation axis 44. The longitudinal fold line orientation axis 44 defines a longitudinal fold line to longitudinal axis angle 46 between the longitudinal fold line orientation axis 44 and the plate longitudinal axis 34.

The longitudinal fold line orientation axis 44 also defines a longitudinal fold line to transversal axis angle 48 between the longitudinal fold line orientation axis 44 and the plate transversal axis 36. The longitudinal fold line to longitudinal axis angle 46 is smaller in value than the longitudinal fold line to transversal axis angle 48 so that the longitudinal segment fold line 42 extends in a more longitudinal than transversal direction.

Typically, the segment longitudinal fold line 42 extends in a parallel relationship relative to the plate longitudinal axis 34. In some situations, it may be desirable that the longitudinal segment fold line 42 extends at an angle relative to the plate longitudinal axis 34.

In other situations such as exemplified by the embodiments shown in FIGS. 1, 5*a*, 6 and 7 at least one of the longitudinal fold lines 42 will have a somewhat curved general configuration. In such instances, the segment longitudinal fold line orientation axis 44 is defined as an axis splicing through the segment longitudinal fold line 42 and averaging the general direction of the segment longitudinal fold line 42. In the example shown in FIG. 1, the segment longitudinal fold line orientation axis 44 is both curved and at an angle relative to the plate longitudinal axis 34.

The weighted plate 22 also includes a generally transversely extending transversal bending means for allowing said weighted plate 22 to bend so as to conform to longitudinal variations in the contour of the sole of the foot of the intended user. Preferably, the transversal bending means includes a segment transversal fold line 50 extending between the first pair of plate segments 38, 40 and a second pair of plate segments 52, 54. Typically, the first and second pair of plate segments 38, 40 and 52, 54 have their respective plate segments separated by the segment longitudinal fold line 42. Preferably, the segment longitudinal fold line 42 extends across the weighted plate 22 from the plate toe end 28 to the plate heel end 30.

Figure 5A:
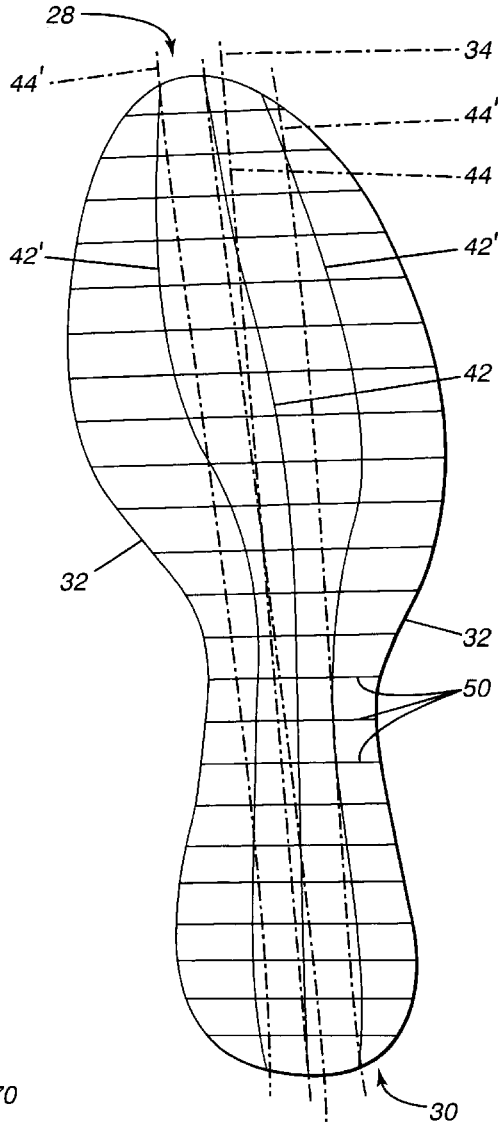
FIG. 5*a*: in a top view illustrates a set of plate segments, part of a weighted footwear insert in accordance with an embodiment of the present invention.

In one of the preferred embodiments illustrated in FIG. 5*a* the weighted footwear insert 10 defines a main segment longitudinal fold line 42 and a pair of auxiliary fold lines 42'. The main segment longitudinal fold line 42 extends substantially longitudinally across the weighted plate 22 and is substantially centrally positioned relative to the plate peripheral edges 32. The auxiliary longitudinal fold lines 42' are positioned on each side of the main longitudinal fold line 42 and follow directions so as to be in a generally central position between the main longitudinal told line 42 and an adjacent plate peripheral edge 32. The auxiliary longitudinal fold lines 42' extend substantially along auxiliary longitudinal axes 44'.

As illustrated in FIG. 5*a*, the weighted footwear insert 10 preferably defines a plurality of segment transversal fold lines 50 that extend across the weighted plate 22. It should be understood that although FIG. 5*a* illustrates a weighted footwear insert having 21 segment transversal fold lines 50, the number of segment transversal fold lines 50 could vary without departing from the scope of the present invention.

Also, although the transversal fold lines 50 illustrated in FIG. 5*a* are shown having a generally rectilinear configuration it should be understood that the segment transversal fold lines 50 could have a curved, sine waved, parabolic, hyperbolic or otherwise shaped configurations without departing from the scope of the present invention.

Typically, the transversal and longitudinal fold lines 42, 50 are shaped and positioned so as to optimize the movements of the weighted footwear insert 10 taking into consideration the various joints of the human foot. The shape and position of both the longitudinal and transversal fold lines 42, 50 are optimized so as to take into consideration the various joints of the foot and the various possible movements of the foot including torsion as hereinabove mentioned.

Figure 6:
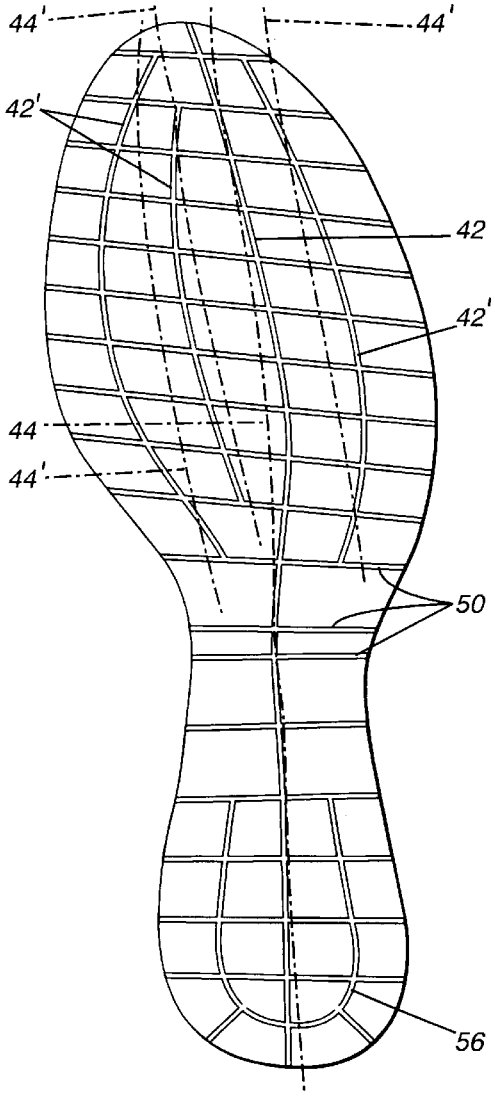
FIG. 6: in a top view illustrates a set of plate segments, part of a weighted footwear insert in accordance with an alternative embodiment of the present invention.

For example, FIG. 6 illustrates another embodiment of the invention wherein the weighted footwear insert 10 defines a main segment longitudinal fold line 42 and a set of auxiliary longitudinal fold lines 42'. The main segment longitudinal fold line 42 extends substantially longitudinally across the weighted plate 22 and is substantially centrally positioned relative to the plate peripheral edges 32.

The auxiliary longitudinal fold line 42' are positioned on each side of the main longitudinal fold line 42 between the main longitudinal fold line 42 and adjacent plate peripheral edges 22. The auxiliary fold lines 42' extend from the plate toe end 30 to a position intermediate to the plate toe and heel ends 30, 28. The weighted footwear insert 10 shown in FIG. 6 also includes a plurality of segment transversal fold lines 50 and a generally U-shaped fold line 56 positioned generally adjacent to the plate heel end 28.

Figure 7:
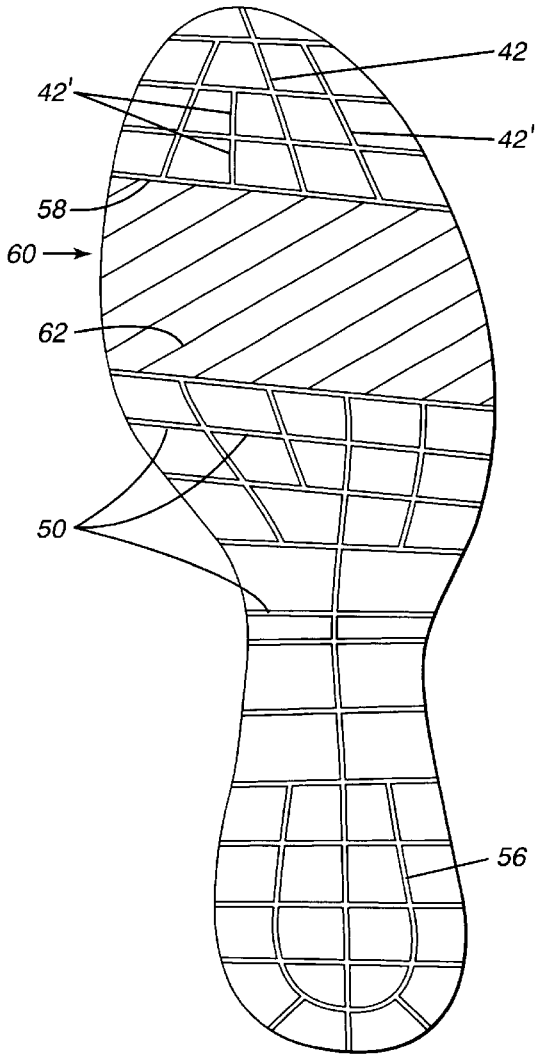
FIG. 7: in a top view illustrates a set of plate segments, part of a weighted footwear insert in accordance with yet another alternative embodiment of the present invention.

FIG. 7 illustrates yet another example of a preferred embodiment of the invention. The weighted footwear insert 10 further includes a plate aperture 58 extending through the plate 22 adjacent to a ball-of-the-foot section 60. The plate aperture 58 is filled with a generally resilient material such as thin block or strip 62 of suitable polymeric or elastomeric resin. It should be understood that the configuration, size and position of the plate aperture 58 and associate block or strip 62 could vary without departing from the scope of the present invention.

The block or strip 62 not only provides a section having relatively resilient characteristics, it also provides a section of lesser density thus allowing to shift the center of mass of the weighted plate 22 towards the plate heel end 28. This shift in the centre of mass could also be obtained by other means such as providing plates of various densities or configuration. Regardless of the method use, the longitudinal or transversal shift in the centre of mass relative to the centre of mass that would be obtained trough the use of a uniform plate allows for the targeting of predetermined and specific muscle groups during training.

In another embodiment of the invention (not illustrated), the longitudinal and transversal fold lines 42, 50 are configured and positioned so as to be substantially in register with the various joints of the human foot. In order to precisely take into account the anatomic and ergonomic inter-individual variations, the configuration and shape of the longitudinal and transversal fold lines 42, 50 could be adjusted according to measurements taken on the intended user and the insert 10 could be customized according to a manufacturing method hereinafter disclosed.

Figure 4A:
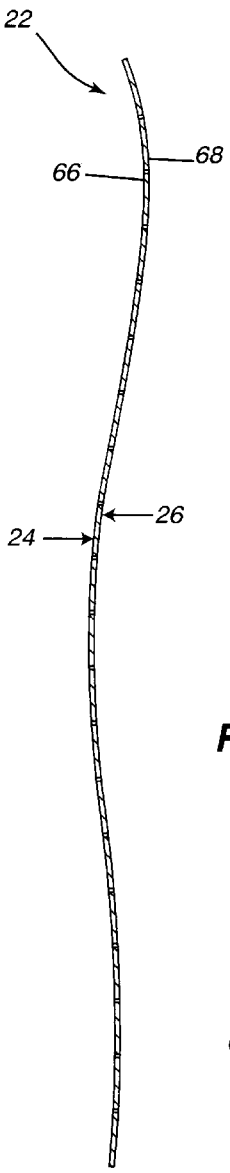
FIG. 4*a*: in a longitudinal cross-sectional view taken along arrows 4—4 of FIG. 3, illustrates the cross-sectional configuration of a weighted footwear insert in accordance with an embodiment of the present invention.
Figure 4B:
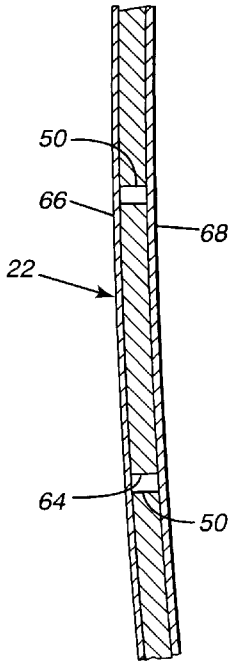
FIG. 4*b*: in a partial detailed cross-sectional view, illustrates the cross-sectional relationship between some of the components of a weighted footwear insert in accordance with an embodiment of the present invention.

As shown more specifically in FIG. 4*b*, in one embodiment of the invention, the plate segments are disposed relative to each other so as to define a segment spacing 64 therebetween. The weighted footwear insert 10 further includes a flexible coupling means attached to adjacent plate segment for flexibly coupling adjacent plate segments together so as to allow bending there between about the coupling means.

In a preferred embodiment of the invention, the flexible coupling means include a first flexible membrane 66 fixed to the plate first surface 24 on adjacent plate segments. The first flexible membrane extends across the segment spacings 64. Preferably, the first flexible membrane 66 is adhesively secured to the plate first surface using a suitable adhesive material.

Preferably, the flexible coupling means also includes a second flexible membrane 68 fixed to the plate second surface 26 on adjacent plate segments. The second flexible membrane extends across the segment spacing 64 and is preferably adhesively secured to the plate second surface 26 using a suitable adhesive material.

Figure 4C:
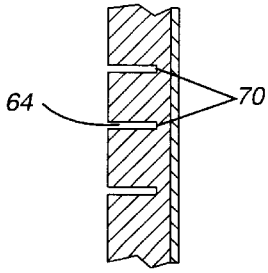
FIG. 4*c*: in a partial detailed cross-sectional view, illustrates the cross-sectional relationship between some of the components of a weighted footwear insert in accordance with an alternative embodiment of the present invention.

Alternatively, as illustrated in FIG. 4*c*, the coupling means include a flexible web 70 of material extending integrally between adjacent plate segments. Although the flexible web 70 is shown extending from a position adjacent to the second plate surface 26 it should be understood that the flexible web 70 could extend at other locations between adjacent plate segments.

Optionally, the coupling means allows bending of the plate segments only within a predetermined limited bending range or offers predetermined resilient resistance to the bending. For example, the coupling means could selectively limit the bending range or increase the bending resistance in the area adjacent the heel end 28 so as to target the muscles linked to that area. The limiting of the bending range and/or increase in bending resistance could be accomplish through different shapes of web 70, localized variations in the physical characteristics of the flexible membranes 66, 68, filling of some or all of the spacings 64 with suitable material or any other suitable means.

Optionally, the plate segments are made of materials having different densities. Optionally, the plate segments have different cross-sectional configurations or different thickness. For example, the various plate segments could be individually shaped so that assembled together they form an elevated arch support.

Typically, the plate segments are adapted to move independently one from the other. Furthermore, since a plurality of plate segments is preferably used, the pressure exerted by the foot of the intended user is directly transmitted to the shoe structure with reduced undue redistribution or attenuation.

Typically, although by no means exclusively, the thickness of the weighted plate 22 has a value substantially in the range between 35 and 85 thousands of an inch. Also, preferably, the weighted plate 22 is made out of steel, magnetic, or other suitable material. Also preferably, the flexible membranes 66, 68 are made out of nylon or out of a suitable polymeric or elastomeric resin.

The present invention also relates to a method of forming a weighted footwear insert. The method includes the steps of first cutting a blank having substantially the planform of an insole out of a relatively thin piece of generally dense material. Once the blank is formed, the second step involves forming at least one generally longitudinally oriented longitudinal fold line 42 and a set of generally transversally oriented transversal fold lines 50 in the blank.

Various methods could be used for forming both the blanks and the longitudinal and transversal fold lines 42, 50. For example, a conventional punch and dye method could be used especially in situations wherein the embodiment including a flexible web 70 between adjacent plate segments is preferred. Alternatively, sources of localized energy such as a laser or a high-pressure water cutter could be used.

Figure 5B:
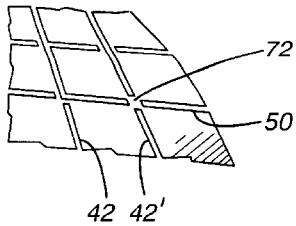
FIG. 5*b*: in a partial top view with sections taken-out illustrates the optional connection between a set of plate segments, part of a weighted footwear insert in accordance with an embodiment of the present invention.

When a source of localized energy is used as a cutting means the pattern of the cutting head is preferably optimized. As illustrated in FIG. 5*b* the fold lines are preferably initially cut so that a corner section 72 of each plate segment remains attached to an adjacent plate segment. This allows the plate to remain substantially integral for handling and further processing such as mounting of the optional flexible membranes 66, 68 shown in FIG. 1. The corner sections 72 linking adjacent plate segments at corner sections thereof are eventually severed either during manufacture or use. They are configured and size so as to minimize the risks of chaffing.

Optionally, the method of forming the weighted footwear insert 10 further includes the step of initially determining an optimized blank configuration and fold line pattern for the foot of the intended user, taking into consideration the physiological characteristics of the foot prior to cutting the blank and the longitudinal and transversal fold lines 42, 50 according to the optimized blank configuration and fold line pattern.

For example, the optimized blank configuration and fold line pattern can be determined using conventional foot sensors typically used for evaluating weight distribution on the sole of the foot of an intended user. Once the weight distribution is established a suitable algorithm preferably incorporated into a computer program can be run for determining the optimized blank pattern and positioning of the fold lines taking into consideration anatomical considerations such as the precise positioning of the foot joints.

The embodiments of the invention in which an exclusive privilege or property is claimed are defined as follows:

1. A weighted footwear insert for use inside a footwear, said footwear being wearable by a foot of an intended user, said foot having a foot sole, said footwear including a generally elongated insole, said insole defining an insole peripheral edge, an insole longitudinal axis and an insole transversal axis, said footwear insert comprising:

a weighted plate, said weighted plate defining a plate first surface, a plate second surface, a plate toe end, a plate heel end, a plate peripheral edge, a plate longitudinal axis and a plate transversal axis, said weighted plate being configured and sized for insertion into said footwear with said plate longitudinal axis extending in a direction generally parallel to said insole longitudinal axis and said plate transversal axis extending in a direction generally parallel to said insole transversal axis;

said weighted plate defining a first pair of plate segments, said plate segments defining a segment longitudinal fold line therebetween for allowing said plate segments to fold relative to one another about said segment longitudinal fold line;

said segment longitudinal fold line defining a longitudinal fold line orientation axis, said longitudinal fold line orientation axis defining a longitudinal fold line-to-longitudinal axis angle between said longitudinal fold line orientation axis and said plate longitudinal axis, said longitudinal fold line orientation axis defining a longitudinal fold line-to-transversal axis angle between said longitudinal fold line orientation axis and said plate transversal axis; said longitudinal fold line-to-longitudinal axis angle being smaller in value then said longitudinal fold line-to-transversal axis angle;

said weighted plate also including a generally transversally extending transversal bending means for allowing said weighted plate to bend along said transversal bending;

whereby said longitudinal segment fold line extends in a more longitudinal then transversal direction for allowing said weighted plate to substantially follow the transversal contour of said foot sole.

2. A weighted footwear insert as recited in claim 1 wherein said transversal bending means includes a segment transversal fold line extending between said first pair of plate segments and a second pair of plate segments, both said first and said second pair of plate segments having their respective plate segments separated by said segment longitudinal fold line.

3. A weighted footwear insert as recited in claim 2 wherein said plate segments are disposed relative to each other so as to define a segment spacing therebetween; said weighted footwear insert further comprising a flexible coupling means attached to adjacent plate segments for flexibly coupling adjacent plate segments together so as to allow bending therebetween about said coupling means.

4. A weighted footwear insert as recited in claim 3 wherein said flexible coupling means includes a first flexible membrane fixed to said plate first surface on adjacent plate segments, said first flexible membrane extending across said segment spacing.

5. A weighted footwear insert as recited in claim 3 wherein said first flexible membrane is adhesively secured to said plate first surface.

6. A weighted footwear insert as recited in claim 3 wherein said flexible coupling means also includes a second flexible membrane fixed to said plate second surface on adjacent plate segments, said second flexible membrane also extending across said segment spacing.

7. A weighted footwear insert as recited in claim 3 wherein said flexible coupling means includes a flexible web of material extending integrally between adjacent plate segments.

8. A weighted footwear insert as recited in claim 3 wherein said coupling means allows bending between said plate segments within a predetermined limited bending range.

9. A weighted footwear insert as recited in claim 2 wherein said first pair of plate segment is made of plate segments having different densities.

10. A weighted footwear insert as recited in claim 2 wherein said first pair of plate segments is made of plate segments having different cross-sectional configurations.

11. A weighted footwear insert as recited in claim 2 wherein said segment longitudinal fold line extends across said weighted plate from said plate toe end to said plate heel end.

12. A weighted footwear insert as recited in claim 2 defining a main segment longitudinal fold line and a pair of auxiliary longitudinal fold lines, said main segment longitudinal fold line extending substantially longitudinally across said weighted plate and being substantially centrally positioned relative to said plate peripheral edges, said auxiliary longitudinal fold lines being positioned on each side of said main longitudinal fold line and following a direction so as to be in a generally central position between said main longitudinal fold line and an adjacent plate peripheral edge.

13. A weighted footwear insert as recited in claim 12 wherein said transversal bending means includes a plurality of segment transversal fold lines.

14. A weighted footwear insert as recited in claim 2 defining a main segment longitudinal fold line and a set of auxiliary longitudinal fold lines, said main segment longitudinal fold line extending substantially longitudinally across said weighted plate and being substantially centrally positioned relative to said plate peripheral edges, said auxiliary longitudinal fold lines being positioned on each side of said main longitudinal fold line between said main longitudinal fold line and an adjacent plate peripheral edge, said auxiliary fold lines extending from said plate toe end to a position intermediate said plate toe and heel ends, said weighted footwear insert also including a plurality of segment transversal fold lines and a generally "U"-shaped fold line positioned adjacent said plate heel end.

15. A weighted footwear insert as recited in claim 2 further comprising a plate aperture extending through said plate, said plate aperture being filled by a generally resilient material.

16. A weighted footwear insert for use inside a footwear, said footwear being wearable by a foot of an intended user, said foot having a foot sole, said weighted footwear insert comprising:

a weighted plate, said weighted plate defining at least one generally longitudinally oriented longitudinal fold line and a set of generally transversally oriented transversal fold lines for allowing said weighted plate to fold according to the configuration of said foot sole and to follow the changes in configuration of said foot sole during movement of said foot; said at least one longitudinal fold line and said transversal fold lines defining independently moveable plate segments therebetween, adjacent plate seaments being spaced apart by a corresponding segment spacing; said weighted footwear insert further comprising a flexible coupling means attached to adjacent plate segments for flexibly coupling adjacent plate segments together so as to allow bending therebetween about said coupling means; said flexible coupling means including at least one flexible membrane extending between adjacent plate segments.

17. A weighted footwear Insert as recited in claim 16 wherein said flexible coupling means includes a first flexible membrane fixed to said plate first surface on adjacent plate segments, said first flexible membrane extending across said segment spacing.

18. A weighted footwear insert as recited in claim 16 wherein said first flexible membrane is adhesively secured to said plate first surface.

19. A weighted footwear insert as recited in claim 17 wherein said flexible coupling means also includes a second flexible membrane fixed to said plate second surface on adjacent plate segments, said second flexible membrane also extending across said segment spacing.

20. A weighted footwear insert as recited in claim 16 wherein said flexible coupling means includes a flexible web of material extending integrally between adjacent plate segments.

21. A weighted footwear insert as recited in claim 16 wherein said coupling means allows bending between said plate segments within a predetermined limited bending range.

22. A weighted footwear insert as recited in claim 16 wherein at least two of said plate segments have different densities.

23. A weighted footwear insert as recited in claim 16 wherein at least two of said plate segments have different cross-sectional configurations.

24. A weighted footwear insert as recited in claim 16 wherein said longitudinal fold line extends across said weighted plate from a plate toe end to a plate heel end.

25. A weighted footwear insert as recited in claim 16 further comprising a plate aperture extending through said plate, said plate aperture being filled by a generally resilient material.

26. A method of forming a weighted footwear insert comprising the steps of cutting a blank having substantially the planform of an insole out of a relatively thin piece of substantially dense material;

forming fold lines in said blank, said fold lines defining blank segments therebetween, said fold lines being configured so that adjacent blank segments at least initially remain attached together by a web extending at least partially therebetween;

mounting a flexible membrane over said blank;

allowing said web between adjacent blank segments to be severed so that said blank segments are joined together and allowed to move relative to each other by said flexible membrane.

27. A method as recited in claim 26 further comprising the step of:

determining an optimized blank configuration and fold line pattern for said foot taking into consideration the physiological characteristics of said foot prior to cutting said blank and said longitudinal and transversal fold lines according to said optimized blank configuration and fold line pattern.

* * * * *